US007305776B2

(12) United States Patent
Hess

(10) Patent No.: US 7,305,776 B2
(45) Date of Patent: Dec. 11, 2007

(54) INTEGRATED FLEXIBLE METATARSAL GUARD WITH EXTENDED TOE CAP

(75) Inventor: Jerome Mark Hess, Wausau, WI (US)

(73) Assignee: Weinbrenner Shoe Company, Inc., Merrill, WI (US)

( * ) Notice: Subject to any disclaimer, the term of this patent is extended or adjusted under 35 U.S.C. 154(b) by 549 days.

(21) Appl. No.: 10/902,758

(22) Filed: Jul. 30, 2004

(65) Prior Publication Data

US 2006/0021256 A1 Feb. 2, 2006

(51) Int. Cl.
*A43C 13/14* (2006.01)

(52) U.S. Cl. ..... 36/72 R; 36/77 R

(58) Field of Classification Search ..... 36/72 R, 36/77 R, 77 M, 96, 55
See application file for complete search history.

(56) References Cited

U.S. PATENT DOCUMENTS

| | | | | |
|---|---|---|---|---|
| 2,615,261 | A | 10/1952 | Grotto | |
| 2,915,837 | A * | 12/1959 | Schlecht | 36/72 R |
| 2,988,829 | A | 6/1961 | Johnsen | |
| 3,206,874 | A | 9/1965 | Ellis et al. | |
| 4,342,159 | A | 8/1982 | Edwards | |
| 4,656,761 | A | 4/1987 | Lord | |
| 4,908,963 | A * | 3/1990 | Krajcir et al. | 36/77 R |
| 4,967,493 | A | 11/1990 | Mues | |
| 5,457,898 | A | 10/1995 | Fortin et al. | |
| 5,878,511 | A | 3/1999 | Krajcir | |
| 6,161,313 | A | 12/2000 | Bisson | |
| 6,381,876 | B2 | 5/2002 | Krajcir | |
| 6,389,715 | B1 * | 5/2002 | Krajcir | 36/77 R |
| 6,618,962 | B1 | 9/2003 | Covatch | |
| 6,631,569 | B1 | 10/2003 | Scharbius et al. | |
| D485,020 | S | 1/2004 | Yake et al. | |
| 2002/0184794 | A1 * | 12/2002 | Peterson et al. | 36/72 R |

* cited by examiner

*Primary Examiner*—Marie Patterson
(74) *Attorney, Agent, or Firm*—Reinhart Boerner Van Deuren s.c.

(57) ABSTRACT

A unitary flexible metatarsal guard is disclosed which extends to cover a toe protector in a safety shoe or boot. The metatarsal guard of the present invention acts to transfer and disperse impact forces from the region of impact to a broader region, including the metatarsal and toe regions, thereby distributing the force over a greater surface area. The metatarsal guard of the present invention allows a full range of motion of the foot and conforms to natural crouching, walking, and running movements is designed so as to prevent any pinching, cutting, or other irritation of the wearer's foot.

19 Claims, 6 Drawing Sheets

INTEGRATED FLEXIBLE METATARSAL GUARD WITH EXTENDED TOE CAP

BACKGROUND OF THE INVENTION

Field of the Invention

The present invention relates generally to safety footwear, and more particularly to safety boots and shoes that integrally incorporate a flexible metatarsal guard that covers the toe protector and protects the metatarsal region (the instep region) of the wearer's foot from injury caused by objects falling or rolling onto the toe or metatarsal regions of the wearer's foot.

The metatarsal region or instep of the human foot extends forwardly from the front of the ankle to the base of the toes and contains a number of elongated bones extending side by side. The instep of the foot is particularly vulnerable to impact and crushing forces, especially those caused by falling or dropped objects. This region of the foot may also be injured if the metatarsal guard is allowed to move from its intended position. Yearly, over 120,000 people are injured in such accidents. The American National Standards Institute ("ANSI") has developed a standard for footwear manufacturers to follow to ensure proper foot protection. The current standard is the ANSI Z41-1999 standard, which is approved by the Occupational Safety and Health Administration ("OSHA"). A certification under this standard for personal protective equipment including safety footwear is necessary in order to obtain consumer confidence.

Footwear manufacturers have manufactured steel-toed boots and shoes with a variety of metatarsal guards and cushions in an attempt to prevent the injuries described above. The most common method of protecting the metatarsal region is by placing a tough, rigid, synthetic plastic or metal shield over the exterior of the shoe to cover the metatarsal region of the foot. One example of such a shield is illustrated in U.S. Pat. No. 3,995,382, to Smith. This method of protecting the metatarsal region creates an unsightly and clumsy appearance of the shoe. Furthermore, the rigid shield limits the range of motion of the foot during walking or running. The external metatarsal shield also pinches the instep when bending or squatting. More importantly, this type of metatarsal shield creates a snagging and tripping hazard which could cause serious injury. The disadvantages described above make the Smith safety shoe an uncomfortable shoe that most people would not wear.

Others have incorporated the rigid synthetic plastic or metal metatarsal shield into a fabric or leather cover usually matching the material the footwear is made from. This covered shield is then attached to the toe of the boot. In effect, the metatarsal shield becomes a second tongue placed over the exterior of the safety boot. This external shield does not solve the problems mentioned above which are associated with the uncovered, external metatarsal protectors. The shoes remain bulky and clumsy in appearance. Furthermore, the metatarsal protectors continue to be rigid, which prevents a full range of foot motion and results in fewer individuals wearing such protective equipment. Lastly, these types of metatarsal guards continue to present a tripping and snagging hazard.

In an attempt to create a more aesthetically pleasing and comfortable safety boot that minimizes the tripping and snagging hazard presented by external metatarsal shields, manufacturers have experimented with integrating metatarsal protectors into a steel-toed boot. U.S. Pat. No. 4,102,062, to Adams, discloses a metatarsal protector made from rigid synthetic plastic material that is integrally incorporated into the boot. This method of protecting the metatarsal region continues to prevent the wearer of the boot from walking freely, and limits the range of motion of the foot because the rigid synthetic plastic material cannot bend or flex with the contours of the foot during walking or running. Because such safety boots cannot bend or flex properly, and are therefore uncomfortable, individuals are deterred from wearing such footwear. Furthermore, the integrated metatarsal protectors only cover the metatarsal region and are attached or hinged side-by-side to the steel toe cap.

The evolution of metatarsal guards has been advanced by others who have integrated hinged metal or plastic metatarsal guards that abut end-to-end with steel toe caps. Because separate metatarsal pieces are overlapped or hinged and attached adjacent to the steel toe, the wearer's foot is often pinched between the movable parts. Additionally, these types of guards have been found not to adequately distribute the impact forces of falling objects, which may thus result in point of contact injuries. Furthermore, upon impact forces or over time, the metal, plastic sections, rivets, and threaded, glued, or hinged connections can break or come loose. This can cause the safety footwear to become unwearable, or even worse, can come loose and move out of the protective area of the foot. As with other metatarsal protectors, this type of metatarsal guard creates an uncomfortable shoe that people do not want to wear.

Thus, there remains a need to provide a metatarsal guard that protects the metatarsal region of the foot from impacts or blows while at the same time providing comfort, reliability, stability, flexibility and an aesthically pleasing appearance to the boot or shoe.

It is accordingly the primary objective of the present invention that it provide an integrated flexible metatarsal guard that extends over the protective toe cap. It is a related objective that the present invention protects the metatarsal region of the foot from impacts or blows resulting from falling objects, as well as keeping the metatarsal guard secure in its intended position. This objective must be accomplished by meeting or exceeding the ANSI Z41-1999 standard. It is a further related objective of the present invention that the guard be of a flexible nature to allow a full range of motion of the foot, which will provide the wearer with a boot or shoe that allows and conforms to natural crouching, walking, or running movements. Furthermore, the guard of the present invention must be integrally positioned within the footwear to create an aesthetically pleasing appearance.

It is another objective of the guard of the present invention that it be light-weight and comfortable. It must be light enough so as to not fatigue the wearer. The guard of the present invention must also be flexible, with non-moving parts so as to prevent any pinching, cutting, or other irritation of the wearer's foot. Optionally, the guard of the present invention does not require the use of coupling devices or materials, such as hinges, tapes, or adhesives, to be integrally positioned within the footwear and coupled to the protective toe cap.

It is yet a further objective of the present invention that it fully and completely protect the wearer's foot from impact to the metatarsal region and extending over the toes. The guard of the present invention, when used in conjunction with a protective toe cover, such as a steel toe, must extend over the protective toe cover to protect the entire metatarsal region of the foot and toe region. Additionally, the guard of the present invention must act to transfer and disperse impact forces from the region of impact to a broader region, including the metatarsal and toe regions, thereby distributing the force over a greater surface area. This will prevent a direct, single concentrated source of energy from the impact or blow, and prevent point-of-impact injuries to the wearer's foot. Furthermore, forces applied to the guard of the present invention will be transferred to the protective toe cover, thereby further reducing the shock to the wearer's foot.

The guard of the present invention must also be of construction which is both durable and long-lasting, and it should require little or no maintenance to be provided by the user throughout its operating lifetime. In order to enhance the market appeal of a boot or shoe incorporating the guard of the present invention, it should also be of inexpensive construction to thereby be affordable to the broadest possible market. Finally, it is also an objective that all of the aforesaid advantages and objectives be achieved without incurring any substantial relative disadvantage.

SUMMARY OF THE INVENTION

The disadvantages and limitations of the background art discussed above are overcome by the present invention. With this invention, an improved metatarsal guard that protects the metatarsal region of the foot from impacts and provides improved support and positioning of the metatarsal guard within a shoe or boot by extending the metatarsal guard to substantially surround and/or shadow a toe protector. The present invention provides comfort, reliability, stability, flexibility, and an aesthically pleasing appearance to the boot or shoe. The present invention also meets the specified ANSI Z41-1991, Section 2 requirement for "Metatarsal Impact Resistance" testing.

In the preferred embodiment, the present invention provides a safety shoe or boot having improved protection for a wearer's foot and including a rigid toe protector affixed between an upper and a sole, and a flexible metatarsal guard integrally positioned inside the upper and covering the instep region of the wearer's foot. The metatarsal guard extends forwardly from the front of the ankle and covers the toe protector. The metatarsal guard is in part adjacent to and interposed between the interior surface of the upper and the toe protector.

In an enhancement, the front portion of the metatarsal guard of the present invention is configured to shadow or overlap the toe protector. By molding the metatarsal guard to shadow the shape of the toe protector, the metatarsal guard of the present invention can cover the toe protector without requiring the use of adhesives. Essentially, the toe protector acts as an anchor for the metatarsal guard and prevents the metatarsal guard from shifting within the shoe or boot. Alternatively, adhesives or tapes can be used to more securely attach the metatarsal guard to the toe protector and/or to facilitate assembly of the shoe or boot.

The configuration of the metatarsal guard of the present invention improves the load distribution of impacts resulting from falling or rolling objects. Load forces are transferred to the toe protector because the toe protector is located directly under and supports the front portion of the metatarsal guard. In addition, the metatarsal guard of the present invention also includes a cushion for absorbing impact forces.

The metatarsal guard preferably utilizes a single flexible unitary plastic piece. The metatarsal guard of the present invention preferably includes a plurality of slits which are located on and extend inwardly from the right and left lateral edge surfaces of the metatarsal guard. These slits prevent the metatarsal guard from impeding movement of the foot when the wearer is crouching, walking, or running.

It may therefore be seen that the present invention teaches a unitary flexible metatarsal guard that extends to cover the toe protector. The metatarsal guard allows a full range of motion of the foot and conforms to natural crouching, walking, and running movements. The metatarsal guard of the present invention has no moving parts which could pinch, cut, or other irritate the wearer's foot. The metatarsal guard of the present invention does not require the use of coupling devices such as hinges, tapes or adhesives to retain the metatarsal guard in place within the footwear and couple it to the toe protector. Additionally, the metatarsal guard of the present invention acts to transfer and disperse impact forces from the region of impact to a broader region, including the metatarsal and toe regions, thereby distributing the force over a greater surface area.

The metatarsal guard of the present invention is of a construction which is both durable and long lasting, and which will require little or no maintenance to be provided by the user throughout its operating lifetime. The metatarsal guard of the present invention is also of inexpensive construction to enhance its market appeal and to thereby afford it the broadest possible market. Finally, all of the aforesaid advantages and objectives of the metatarsal guard of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

The preferred embodiment provides a metatarsal guard that protects the metatarsal region of the foot from impacts or blows and provides for the support and positioning of the metatarsal guard within a shoe or boot by extending the metatarsal guard to substantially surround or shadow a toe protector. The metatarsal guard is in part adjacent to and interposed between the interior surface of the footwear and the toe protector. The front portion of the metatarsal guard of present invention is configured to shadow and overlap the toe protector. The toe protector thereby acts as an anchor for the metatarsal guard and prevents the metatarsal guard from shifting within the footwear. The configuration of the metatarsal guard improves the load distribution resulting from impacts from falling or rolling objects. The metatarsal guard also includes a plurality of slits located in the right and left lateral edge surfaces thereof for preventing the metatarsal guard from impeding movement of the foot while the wearer is walking, running, or crouching.

Figure 1:
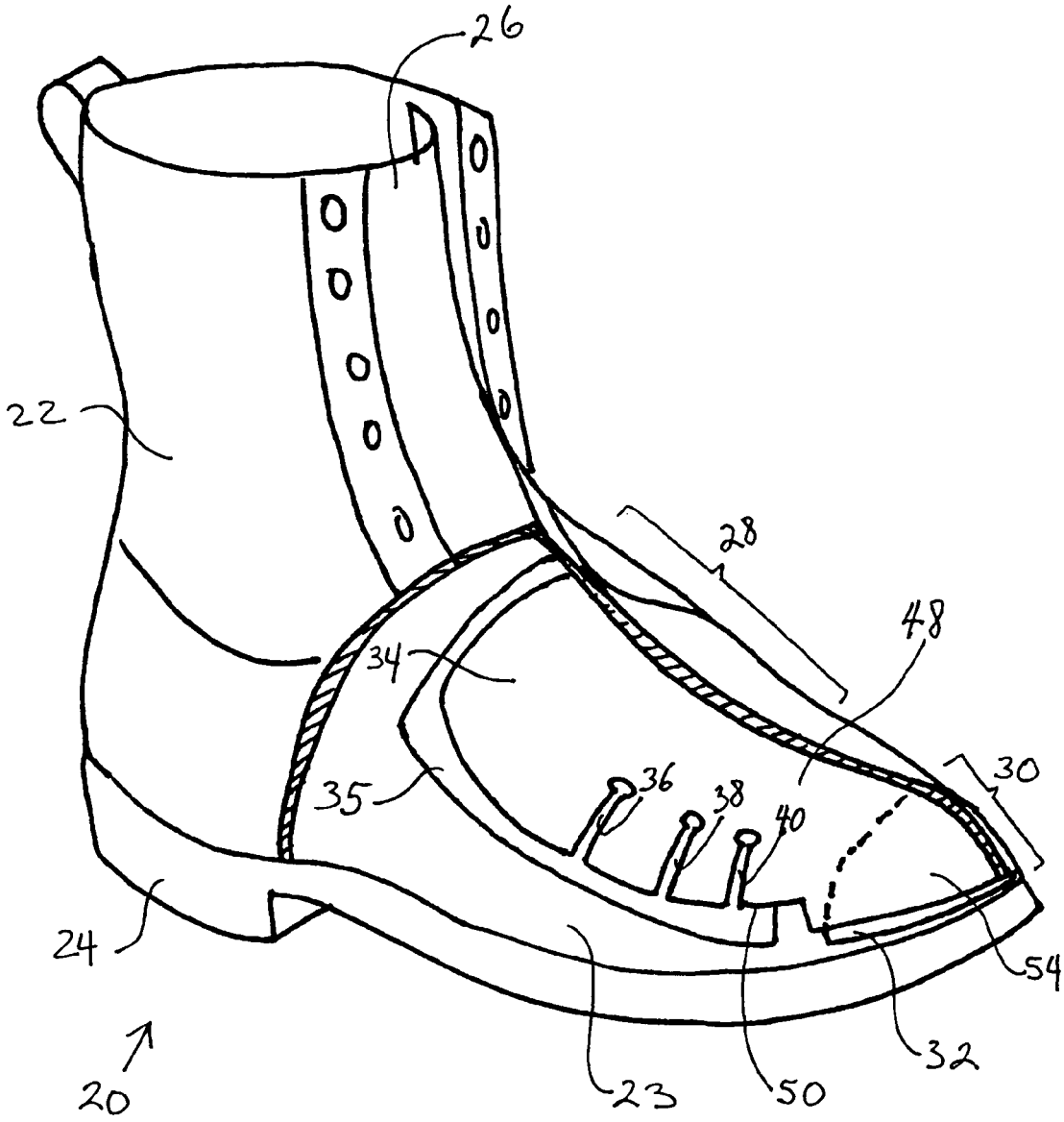
FIG. 1 is a perspective, partially cross-sectional view of a safety boot incorporating a metatarsal guard which is manufactured in accordance with the teachings of the present invention.

Referring first to FIG. 1, a safety boot 20 is shown with an integrally positioned flexible metatarsal guard 34 which is made according to the teachings of the present invention. Prior to a discussion of the components of the present invention, it may be helpful to first discuss the well-known elements of a typical safety boot 20. The safety boot 20 has an upper member 22 which is attached to a sole 24.

Those skilled in the art will appreciate that soles for safety footwear may also include other structural elements such as a midsole, a steel plate to prevent punctures, and cushions (none of which are illustrated in FIG. 1). The upper member 22 includes a tongue 26 and a vamp or an instep region 28, and may be made from leather or from any of a number of other materials known to those skilled in the art, including both natural and synthetic materials. A rigid toe protector 32 is placed inside the toe region 30 of the upper member 22 to protect the wearer's toes from falling objects.

The toe protector 32 has a generally U-shaped lateral cross-sectional configuration. Typically, the toe protector 32 is placed between an inner lining 23 and the interior of the upper member 22. The toe protector 32 lies adjacent to the interior surface of the toe region 30 of the upper 22 and extends downwardly to the sole 24 on the sides and front of the toe protector 32. This allows impact on the safety boot 20 in the toe region to be transferred from the toe protector 32 to the sole 24, and, ultimately, to the ground.

The rigid toe protector 32 forms a space for the wearer's toes and conforms to the general shape of the toe region 30. Typically, the toe protector 32 is made from steel, but it may also be manufactured from synthetic polymers such as ABS plastic or other rigid materials known by those skilled in the art to be capable of withstanding impact forces from falling, rolling, or static objects.

The components which have been discussed to this point are presently known in safety boot construction; however, the present invention includes additional components which will now be discussed. The flexible metatarsal guard 34 of the present invention is integrally positioned inside the upper member 22 and extends forwardly from the ankle to cover the rigid toe protector 32, and will thus cover the instep region 28 of a wearer's foot. Preferably, the metatarsal guard 34 closely shadows the outer size and shape of the toe protector 32. The metatarsal guard 34 is arched to follow the natural shape of the top of the foot's instep (the metatarsal region), and extends forwardly to overlap at least the top and side walls of the toe protector 32. In the preferred embodiment, the metatarsal guard 34 overlaps the toe protector 32 in its entirety so that the metatarsal guard 34 is in part adjacent to and interposed between the interior surface of the upper member 22 and the toe protector 32 and the inner lining 23.

In the preferred embodiment, the metatarsal guard 34 is retained in position over the toe protector 32 without the use of adhesive. Alternatively, the metatarsal guard 34 can be affixed to the toe protector 32 by use of an adhesive. In this embodiment, a wearer would not be able to feel the edges of the forward portion of the metatarsal guard 34 which overlaps the toe protector 32 while wearing the safety boot 20. In addition, the close fit of the metatarsal guard 34 over and around the toe protector 32 provides further stability to the metatarsal guard 34 and will prevent the metatarsal guard 34 from shifting inside the safety boot 20.

A cushion 35 located underneath the metatarsal guard 34 is included to increase the comfort level and shock absorption capabilities of the metatarsal guard 34. The cushion 35 may consist of a single layer or multiple layers. Additional layers will help further absorb impact forces from objects impacting the toe of the safety boot 20.

Figure 2:
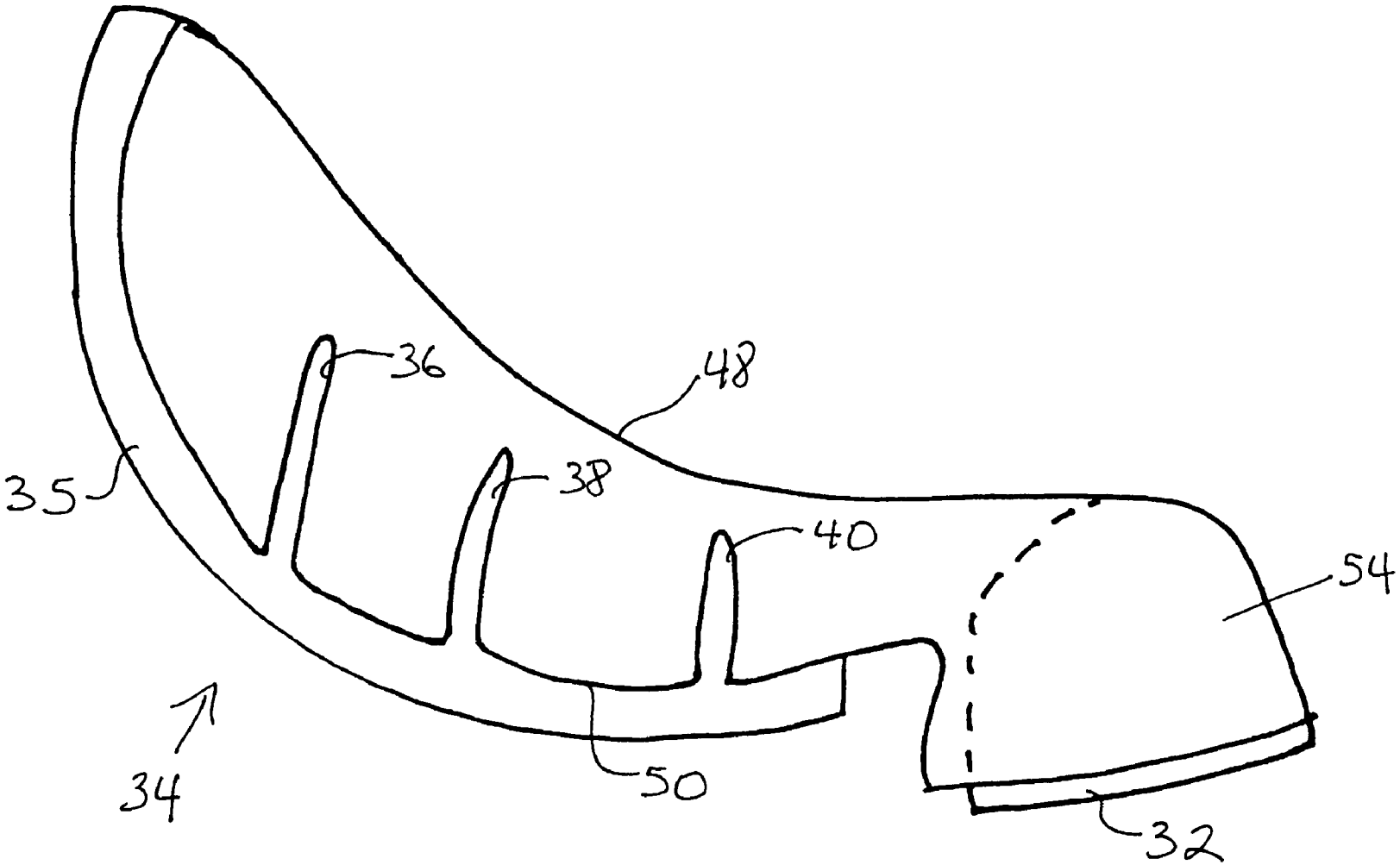
FIG. 2 is a side view of the metatarsal guard from the safety boot illustrated in FIG. 1, showing a cushion and a rigid toe protector.
Figure 3:
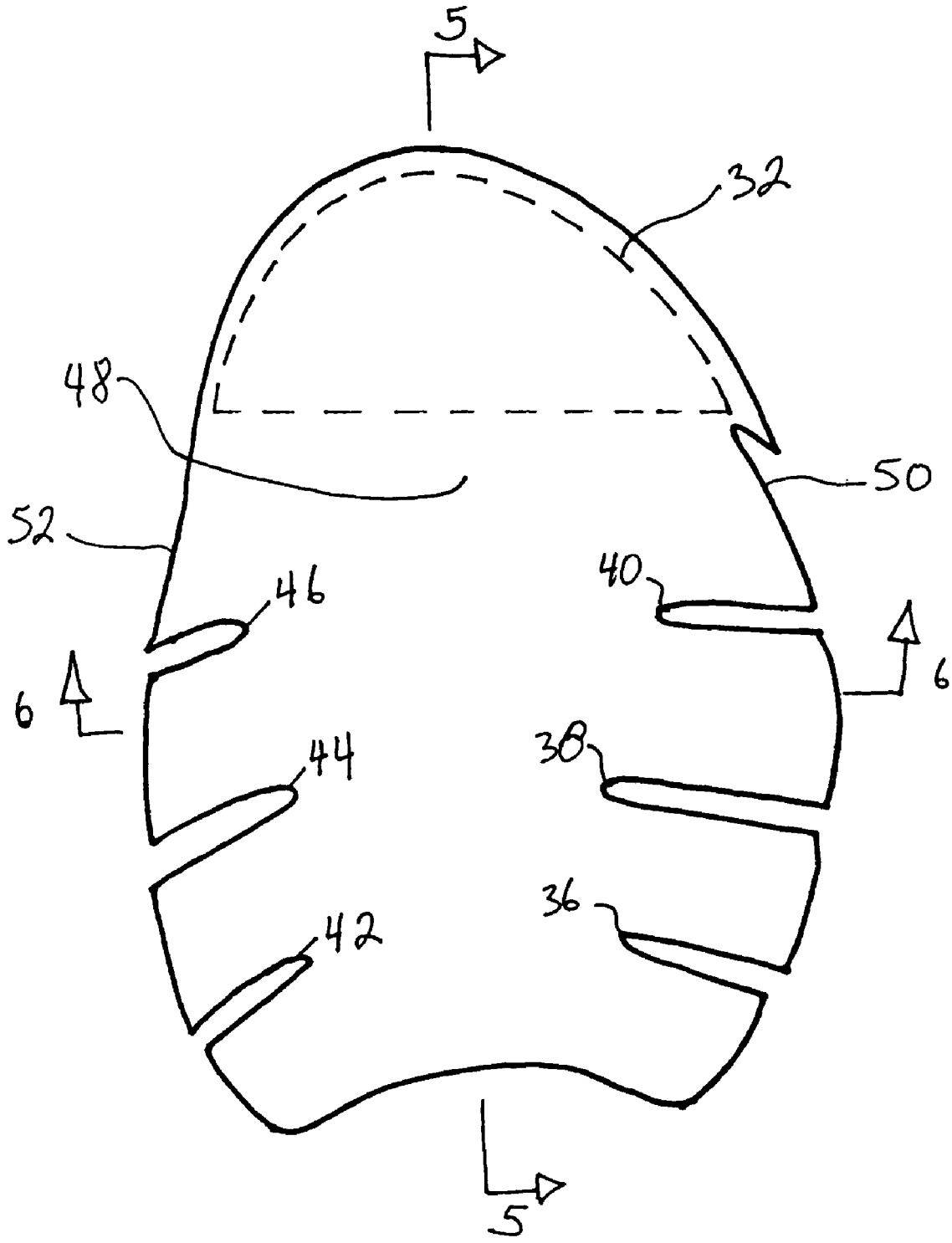
FIG. 3 is a top view of the metatarsal guard illustrated in FIG. 2.
Figure 4:
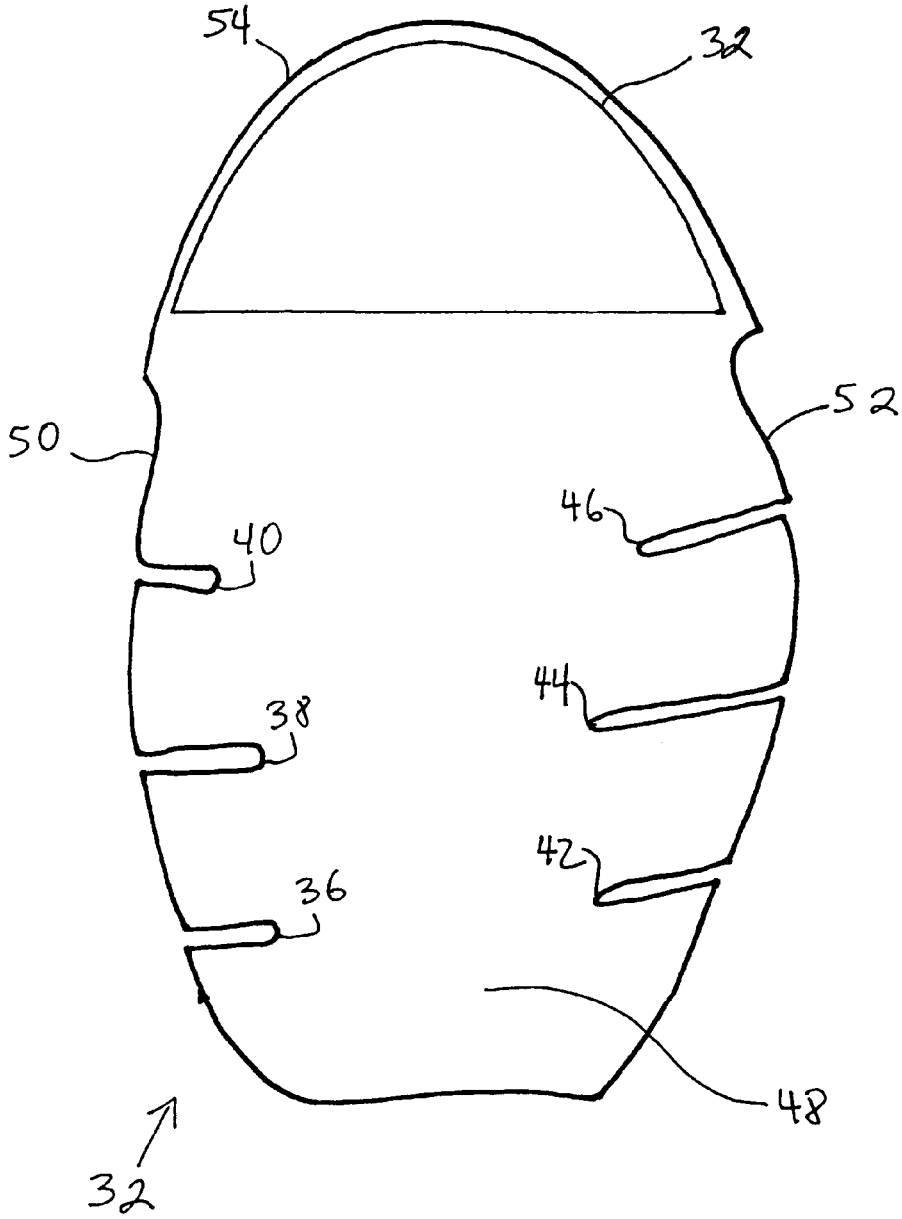
FIG. 4 is a bottom view of the metatarsal guard illustrated in FIGS. 2 and 3, showing the location of the rigid toe protector in phantom lines.

Referring now also to FIGS. 2 through 7, the overall configuration of the metatarsal guard 34 shown in the safety boot 20 in FIG. 1 is illustrated. As best shown in FIGS. 2 to 4, the metatarsal guard 34 includes a right lateral edge 50 and a left lateral edge 52. In the preferred embodiment of the present invention, the lateral edges 50 and 52 of the metatarsal guard 34 do not fully reach the sole 24 on either side of the safety boot 20. Alternately, the lateral edges 50 and 52 can be extended to rest on or substantially abut the top surface of the sole 24 of the safety boot 20.

A front portion 54 of the metatarsal guard 34 rests on top of the toe protector 32 as best shown in FIGS. 2 through 4 and 7. Accordingly, a substantial portion of the load of an object falling on the metatarsal guard 34 will be applied to the toe protector 32 to which the front portion 54 of the metatarsal guard 34 rests, thereby reducing the portion of the load distributed on the instep of a wearer's foot. The load of an impact is further absorbed by and/or distributed to the cushion 35.

Figure 7:
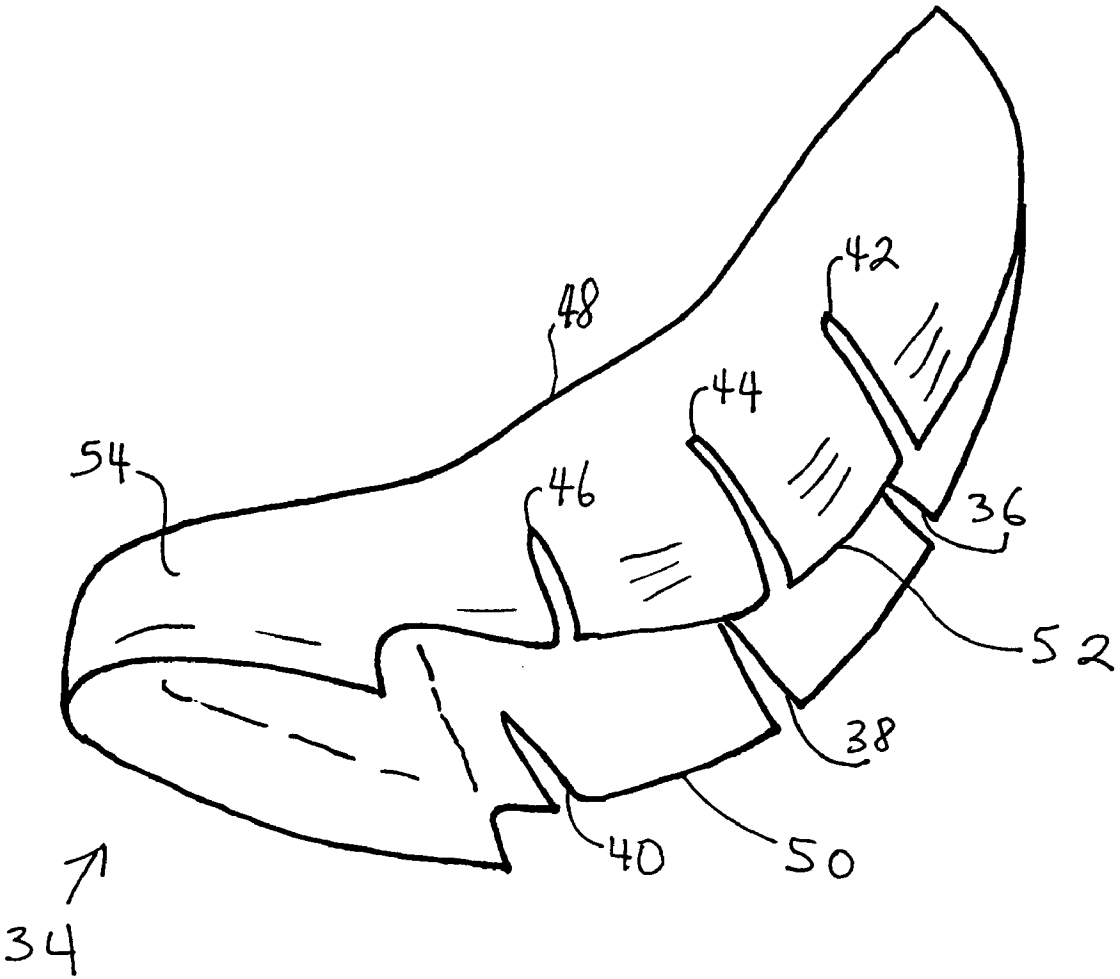
FIG. 7 is a perspective view of the metatarsal guard illustrated in FIGS. 1 through 6.

To facilitate flexion of the metatarsal guard 34 and prevent the metatarsal guard 34 from impeding flexion of the foot of a wearer in a walking, running, or crouching posture, three side slits 36, 38, and 40 extend laterally into the right lateral edge 50 of the metatarsal guard 34 and three side slits 42, 44, and 46 extend laterally into the left lateral edge 52 of the metatarsal guard 34 as best shown in FIGS. 3, 4, and 7. Those skilled in the art will recognize that the slits 36, 38, 40, 42, 44, and 46 can be cut into the metatarsal guard 34, or, alternately, the metatarsal guard 34 can be molded with the slits 36, 38, 40, 42, 44, and 46 located therein.

Figure 5:
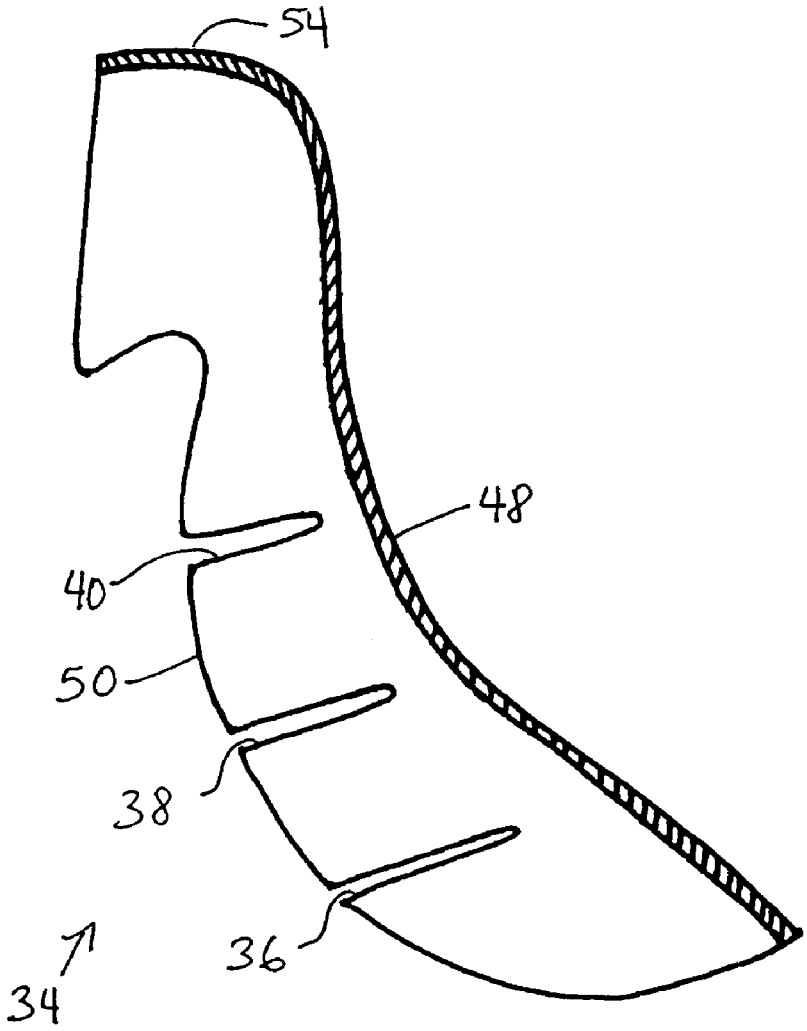
FIG. 5 is a first cross-sectional view of the metatarsal guard illustrated in FIGS. 1 through 4 along a longitudinal axis.
Figure 6:
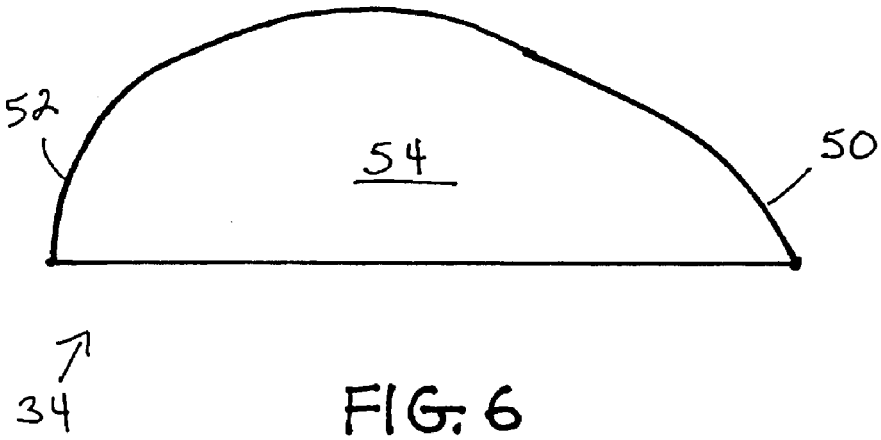
FIG. 6 is a second cross-sectional view of the metatarsal guard illustrated in FIGS. 1 through 5 along a lateral axis.

The slits 36, 38, and 40 extend from near the right lateral edge 50 toward a top surface 48 of the metatarsal guard, as best shown in FIG. 5. Similarly, the slits 42, 44, and 46 extend from the left lateral edge 52 toward the top surface 48 of the metatarsal guard 34. The side slits 36, 38, 40, 42, 44, and 46 allow the metatarsal guard 34 to flex and thereby prevent the metatarsal guard 34 from impeding movement of the foot when the wearer is crouching, walking, or running. Optionally, the cushion 35 can also include corresponding slits (not shown herein) to help the cushion 35 conform to the shape and movement of the metatarsal guard 34.

Although the preferred embodiment shows six slits 36, 38, 40, 42, 44, and 46, one skilled in the art can modify the metatarsal guard 34 of the present invention to include fewer or more slits, as well as varying the length or configuration of the slits. In addition, multiple apertures can be incorporated into the metatarsal guard 34 to further facilitate and increase the flexion of the foot. The apertures, which are shown only in FIG. 1, can be combined with the slits as shown in FIG. 1, or used separately (not shown in the figures), to enhance the flexion of the metatarsal guard 34.

The metatarsal guard 34 is positioned within the safety boot 20 as shown in FIG. 1. The metatarsal guard 34 may be held in place between the inner lining 23 and the toe protector 32 on the bottom side thereof and the interior surface of the upper member 22 of the safety boot 20 on the top side thereof. Alternately, the metatarsal guard 34 can be attached to one or both of the inner lining 23 and the toe protector 32 or the interior surface of the upper member 22 using a double-sided adhesive tape material. As mentioned previously, the metatarsal guard 34 can also be held in place using adhesives if desired.

The metatarsal guard 34 may be made from a sheet of robust, flexible plastic material. Although other plastic materials could be used, the metatarsal guard 34 is preferably made of high density polyethylene or high density polypropylene. The metatarsal guard 34 may be manufactured using molding techniques such as injection molding techniques which are well known to those skilled in the art. Alternatively, the metatarsal guard 34 can be die cut, laser cut, or water cut from flat plastic sheet material, and then thermoformed on a template to obtain a shape that can be integrally positioned within the safety boot 20.

The cushion 35 can be attached to the underside (bottom) of the metatarsal guard 34 by any of a variety of techniques which are well known in the art. For example, the cushion 35 can be attached, glued to, or even sewn onto the metatarsal guard 34. The cushion 35 could instead be attached to the metatarsal guard 34 using a double-sided adhesive tape material.

The cushion 35 can be a single flexible layer of impact-absorbent material or a flexible sandwich of several materials which can bend to accommodate the natural movement of a foot. For example, the cushion 35 could have one or more layers of a cross-linked polyethylene foam material that absorbs impact forces of falling or rolling objects and retains the shape of the instep region 28 of the upper member 22. Although a polyethylene foam layer is described herein, it would be apparent to those skilled in the art to substitute other materials that provide the requisite cushioning and other characteristics in safety boots.

An example of a material which may be used for the cushion 35 is a cellular urethane foam material manufactured by Rogers Corporation under the trademark PORON. Although such a material is utilized in the preferred embodiment, other types of materials such as neoprene sponge, vinyl sponge, sponge rubber, latex foam, and solid viscoelastic material may be used instead.

Optionally, the cushion 35 can also include a material having a mechanical design which allows the material to absorb force, such as the rubber material manufactured by Esjot Goldenberg of Ense, Germany under the trademark META-TEC. Other types of mechanical force absorption materials known to those skilled in the art could also be used. Furthermore, either a single force absorption layer and/or several force absorption layers could be used to make the cushion 35.

Testing has been used to verify the safety of footwear incorporating the metatarsal guard 34 of the present invention. ANSI has developed standards for footwear manufacturers to follow to ensure proper foot protection. The current standard is the ANSI Z41-1999 standard, which is approved by OSHA. Footwear bearing the ANSI Z41 label must meet or exceed the ANSI Z41 standard requirement for that product category.

The metatarsal guard 34 of the present invention was tested for "Metatarsal Impact Resistance" testing in accordance with ANSI standard Z41-1999, Section 2 as Class 75 footwear. The metatarsal guard was tested using an impact test apparatus with a 50-pound steel metatarsal impactor dropped from a height that provides the required impact velocity (as outlined in ANSI Z41-1999, Section 2, which is 96±1.9 inches per second). The minimum impact clearance, which is the distance from the insole to the metatarsal guard, is one inch for men's footwear and 15/16 inches for women's footwear.

Table 1 below shows the recorded results of the testing for men's footwear.

TABLE 1

ANSI Z41, Class 75 Test Results

| Trial Number | Impact Clearance (inches) |
|---|---|
| 1 | 1 4/16 inches |
| 2 | 1 3/16 inches |
| 3 | 1 4/16 inches |
| 4 | 1 3/16 inches |
| 5 | 1 4/16 inches |
| 6 | 1 4/16 inches |

As can be seen, the metatarsal guard 34 of the present invention not only met but exceeded the specified ANSI Z41-1999, Section 2 requirement for "Metatarsal Impact Resistance" testing. Table 1 clearly shows that the metatarsal guard 34 of the present invention exceeded the minimum impact clearance requirement by at least 3/16 of an inch.

It may therefore be appreciated from the above detailed description of the preferred embodiment of the present invention that it provides a unitary flexible metatarsal guard that extends to cover the toe protector. The metatarsal guard allows a full range of motion of the foot and conforms to natural crouching, walking, and running movements. The metatarsal guard has non-moving parts so as to prevent any pinching, cutting, or other irritation of the wearer's foot.

The metatarsal guard does not require (but may optionally utilize) the use of coupling devices or materials, such as hinges or adhesives, to maintain it in position within the footwear and coupled to the toe protector. Additionally, the metatarsal guard acts to transfer and disperse impact forces from the region of impact to a broader region, including the metatarsal and toe regions, thereby distributing the force over a greater surface area.

Finally, it should be noted that the metatarsal guard 34 of the present invention maximizes protection of the instep of a wearer's foot, maintains a high level of comfort even when the wearer is in a crouching posture, and is robust and stable when used in the safety footwear. Furthermore, the metatarsal guard of the present invention exceeded the specified ANSI Z41-1991, Section 2 requirements for "Metatarsal Impact Resistance."

Although the foregoing description of the metatarsal guard of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A safety shoe or boot having improved protection for the metatarsal region of a wearer's foot, comprising:

a sole;

an upper having an interior surface, said upper being affixed to said sole, said upper and said sole defining a cavity for receiving a wearer's foot;

a rigid toe protector, said toe protector being affixed between said upper and said sole; and a flexible metatarsal guard integrally positioned inside said upper, said metatarsal guard covering the instep region of the wearer's foot, said metatarsal guard extending forwardly from the front of the ankle to cover substantially the entirety of said toe protector.

2. A safety shoe or boot as defined in claim 1, wherein said metatarsal guard is arched to follow the natural shape of the top of the foot's instep and extends to cover at least the top and side walls of said toe protector.

3. A safety shoe or boot as defined in claim 1, wherein said metatarsal guard is molded from high density polypropylene or high density polyethylene.

4. A safety shoe or boot as defined in claim 1, wherein said metatarsal guard is adhesively affixed to said toe protector.

5. A safety shoe or boot as defined in claim 1, additionally comprising a cushion for absorbing impact forces, said cushion being located under the portion of said metatarsal guard not covering said toe protector.

6. A safety shoe or boot as defined in claim 1, wherein said metatarsal guard includes a right lateral edge and a left lateral edge, said right and left lateral edges having a plurality of laterally extending slits located therein to prevent said metatarsal guard from impeding flexibility of the wearer's foot.

7. A safety shoe or boot as defined in claim 6, wherein said right and left lateral edges do not fully reach said sole.

8. A safety shoe or boot as defined in claim 6, wherein said right and left lateral edges extend to substantially abut said sole.

9. A safety shoe or boot as defined in claim 1, wherein said metatarsal guard comprises a single flexible unitary plastic segment.

10. A safety shoe or boot having improved protection for the metatarsal region of a wearer's foot, comprising:

a sole;

an upper having an interior surface, said upper being affixed to said sole, said upper and said sole defining a cavity for receiving a wearer's foot;

a rigid toe protector, said toe protector being affixed between said upper and said sole; and a flexible metatarsal guard integrally positioned inside said upper, said metatarsal guard covering the instep region of the wearer's foot, wherein said metatarsal guard is arched to follow the natural shape of the top of the foot's instep and extends to cover substantially the entirety of said toe protector, wherein a front portion of said metatarsal guard is adjacent to and interposed between the interior surface of said upper and said toe protector.

11. A safety shoe or boot as defined in claim 10, wherein said metatarsal guard is taped to said toe protector.

12. A safety shoe or boot as defined in claim 10, wherein said metatarsal guard is adhesively affixed to said toe protector.

13. A safety shoe or boot as defined in claim 10, additionally comprising a cushion for absorbing impact forces, said cushion being located under the portion of said metatarsal guard not covering said toe protector.

14. A safety shoe or boot as defined in claim 10, wherein said metatarsal guard includes a right lateral edge and a left lateral edge, said right and left lateral edges having a plurality of laterally extending slits located therein to prevent said metatarsal guard from impeding movement of the foot.

15. A safety shoe or boot as defined in claim 14, wherein the right and left lateral edge surfaces do not fully reach said sole.

16. A safety shoe or boot as defined in claim 14, wherein the right and left lateral edge surfaces substantially abut said sole.

17. A safety shoe or boot as defined in claim 10, wherein said metatarsal guard is a single flexible unitary plastic piece.

18. A safety shoe or boot having improved protection for the metatarsal region of a wearer's foot, comprising:

a sole;

an upper having an interior surface, said upper being affixed to said sole, said upper and said sole defining a cavity for receiving a wearer's foot;

a rigid toe protector, said toe protector being affixed between said upper and said sole; and a flexible metatarsal guard integrally positioned inside said upper, said metatarsal guard having a first portion covering the instep region of the wearer's foot and a second portion extending forwardly from said first portion, said second portion of said metatarsal guard covering substantially the entirety of said toe protector, said first portion of said metatarsal guard having right and left lateral edges;

a cushion for absorbing impact forces, said cushion being located under said first portion of said metatarsal guard; and a plurality of longitudinally extending slits located in each of said right and left lateral edges of said metatarsal guard to allow said first portion of said metatarsal guard to flex.

19. A method of making a safety shoe or boot having improved protection for a wearer's foot metatarsal region, the method comprising:

attaching an inner lining to an upper, said inner lining and said upper defining a void therebetween;

joining said upper to a sole, said sole and said upper defining a cavity therebetween to accommodate the wearer's foot;

installing a rigid toe protector in said void, said toe protector being located close adjacent to said upper at an end thereof which will receive a wearer's toes when the wearer's foot is located in said cavity;

producing a flexible metatarsal guard adapted to flex and bend with the wearer's foot such that said metatarsal guard will not inhibit the wearer's full range of motion during natural walking and running movements, said metatarsal guard including a front portion designed to overlay substantially the entirety of said toe protector; and inserting said flexible metatarsal guard into said void intermediate said inner lining and said upper such that said front portion of said metatarsal guard overlays said toe protector.

* * * * *